United States Patent [19]

Tanaka

[11] Patent Number: 4,561,269

[45] Date of Patent: Dec. 31, 1985

[54] KEY-EXCHANGEABLE LOCK

[75] Inventor: Minoru Tanaka, Hiroshima, Japan

[73] Assignee: Kabushiki Kaisha Kumahira Seisakusho, Hiroshima, Japan

[21] Appl. No.: 614,189

[22] Filed: May 25, 1984

[30] Foreign Application Priority Data

Jun. 8, 1983 [JP] Japan ..... 58-100881

[51] Int. Cl.[4] ..... E05B 35/12

[52] U.S. Cl. ..... 70/339; 70/355; 70/383

[58] Field of Search ..... 70/337, 339, 382, 355, 70/383, 384

[56] References Cited

U.S. PATENT DOCUMENTS

| | | | |
|---|---|---|---|
| 1,447,065 | 3/1923 | Kihm | 70/385 |
| 3,514,982 | 6/1970 | Bergendahl | 70/355 |
| 4,072,032 | 2/1978 | Phillips | 70/339 |

*Primary Examiner*—Robert L. Wolfe

*Attorney, Agent, or Firm*—Wolder, Gross & Yavner

[57] ABSTRACT

A lock includes a running plate formed integrally with a locking bar and provided with a fence adapted to cooperate with a plurality of tumblers so as to alternatively block and allow retraction of the locking bar, and this mechanism is mounted together with the cooperating components within a lock housing. The tumblers allow retraction of the locking bar when moved by a prescribed key to a unlocking position and this prescribed key, which can move the tumblers to the unlocking position, can be exchanged with another prescribed key by displacing the rotational axes of the tumblers. The rotational axes of the tumblers are rotatably released or fixed by a conversion shaft extending through an opening formed in the tumblers and rotatably supported in the lock housing. The conversion shaft is provided with a stop piece and a locking piece. An operative association is established among the conversion shaft, the running plate and a key guiding member rotatably supporting the prescribed key so that it is impossible to release the rotational axes for its displacement or to fix the rotational axes thus released unless the tumblers have been moved to the unlocking position and are held at this unlocking position.

8 Claims, 11 Drawing Figures

KEY-EXCHANGEABLE LOCK

BACKGROUND OF THE INVENTION

The present invention relates generally to improvements in key-exchangeable locks and, it relates more particularly to an improved lock mechanism permitting the reliable performance of a key-exchanging procedure without any improper operation during the course of such procedure.

With the key-exchangeable lock of the prior art, an error in the sequence of the key-exchanging procedure not only makes it impossible to exchange the existing key to a desired new key but also results in the disabling of the releasing mechanism and it has usually been necessary to then disassemble the lock and to reassemble the tumblers. Such a lock has been disclosed, for example, by U.S. Pat. No. 4,072,032. In this prior art lock, the centre around which the tumblers are rotated is displaceable and, as a consequence, the running plate is also movable even when the predetermined key does not assume the lock releasing position in which the tumblers are held at their released positions. As a result, an erroneous operation would bring the fence out of the gates of the tumblers so that the tumblers are disassembled. If the operator is not familiar with the proper sequence of the key-exchanging procedure, there is a danger that such an erroneous operation might often occur.

SUMMARY OF THE INVENTION

A principal object of the present invention is to provide an improved key-exchangeable lock mechanism so constructed that any erroneous operation is eliminated and the key-exchange procedure can be reliably and easily achieved, the improved mechanism being simple and rugged and overcoming the disadvantages of the earlier structures.

This object is achieved, according to the present invention, by an arrangement in a lock in which the centre around which the tumblers are rotated is displaced and whereby the desired key-exchange is effected wherein the rotational centre of the tumblers can neither be displaced nor fixed unless the tumblers are held by a predetermined key at their lock releasing positions.

DESCRIPTION OF PREFERRED EMBODIMENT

The present invention will be now described more in detail with reference to a preferred emobdiment as shown by the accompanying drawings.

Figure 1:
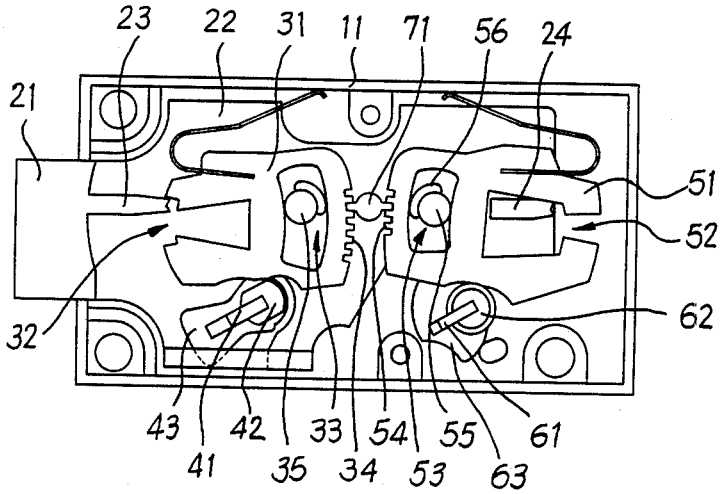
FIG. 1 is a front elevational view of a key-exchangeable lock mechanism in accordance with the present invention as applied to a leased safe-deposit box provided with a client lock and a bank lock.
Figure 2:
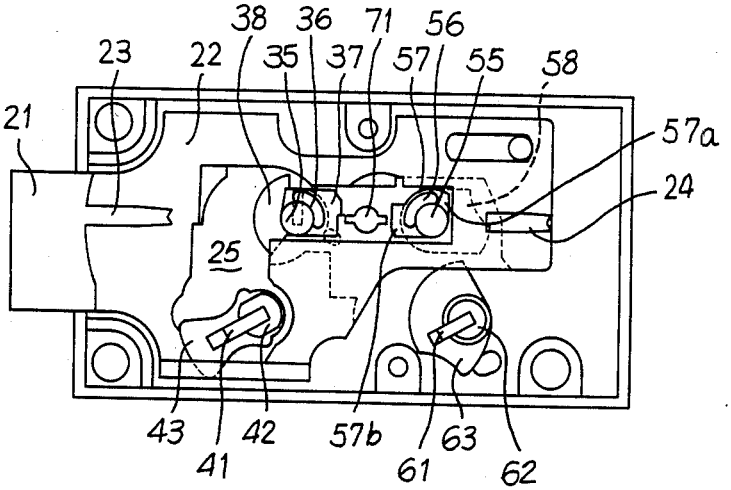
FIG. 2 is a view similar to FIG. 1 but with the tumblers not illustrated.
Figure 11:
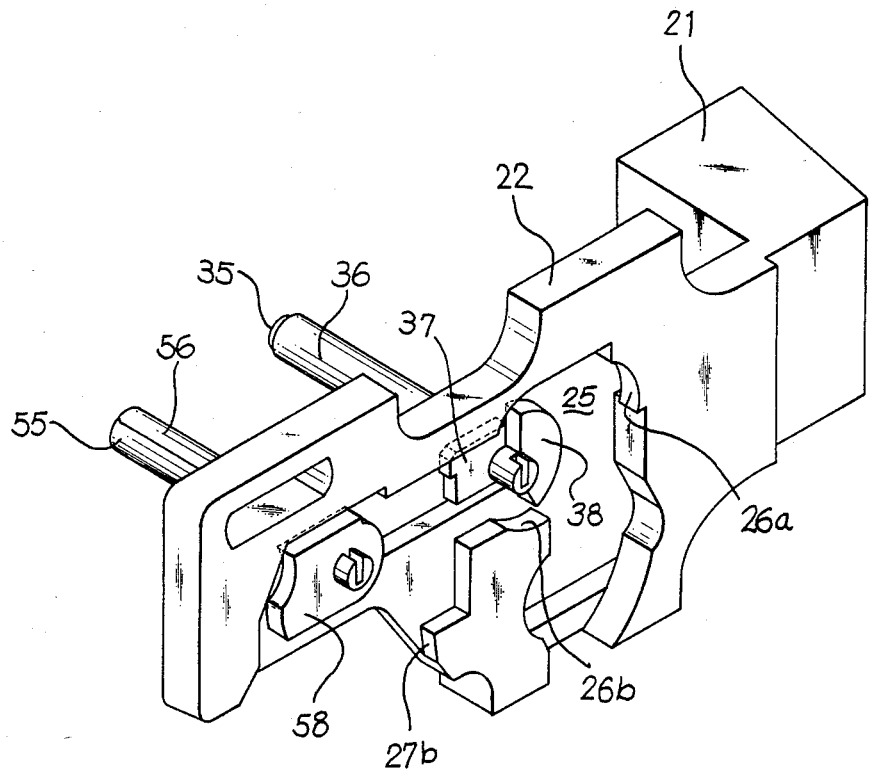
FIG. 11 is a rear perspective view showing the running plate and conversion shaft of the key-exchange mechanism.

Referring to the drawings which illustrate a preferred embodiment of the present invention, the reference numeral 11 generally designates a lock housing in which all of the lock members are arranged and which is mounted on the door of a safe-deposit box. A locking bar 21 is formed and integrally movable with a running plate 22 so that the bar 21 may be advanced and projected out from and retracted into the lock housing 11. The running plate 22 is provided with fences 23, 24 and these fences 23, 24 cooperate with tumblers as will be hereinafter described, so as to prevent and to permit the retraction of said running plate 22. An opening 25 (FIG. 2) is formed in the running plate 22 to receive therein a conversion shaft and a tumbler supporting shaft as weill be described later. Reference numeral 31 designates tumblers for a client lock. Although only one of the tumblers 31 is shown for clarity of illustration, it should be understood that a plurality of tumblers are normally successively stacked preferably with spacers interposed between the respective pairs of adjacent tumblers. Each of the tumblers 31 is provided in its side opposed to the fence 23 with a gate 32 into which fence 23 can enter and provided along an end opposite to said gate 32 with engaging notches 34 in the form of saw-teeth. The engaging notches 34 can engage and disengage an associated one of two diametrically opposed projections formed on a supporting shaft 71 which is, in turn, stationarily mounted in the lock housing 11. When one of these engaging notches 34 engages the associated projection on supporting shaft 71, the tumblers 31 may be rotated or rocked around said one of the engaging notches 34. There is provided adjacent a middle and upper portion of the tumblers 31 a spring normally biasing tumblers 31 downward so that the tumblers 31 are biased to rotate counterclockwise so far as the engaging notches 34 are engaged with the supporting shaft 71. There is provided between the gate 32 and the engaging notches 34 a fan-shaped or curved opening 33 through which a conversion shaft 35 extends. The conversion shaft 35 is rotatably supported in the lock housing 11 and so formed as to be rotatable by a prescribed conversion key from the rear side of the lock housing 11. Further, the conversion shaft 35 includes an eccentric portion 36 adapted to bear against the right side concave surface of the opening 33 formed in the tumblers 31 when the conversion shaft 35 assumes its fixed position as shown by FIGS. 1 and 2, urging the tumblers 31 toward the supporting shaft 71 so that one of the engaging notches 34 may be engaged with the associated projection formed on the supporting shaft 71. There is provided between the opening 33, the conversion shaft 35 and the eccentric portion 36 a play sufficient to allow the tumblers 31 to be smoothly rotated around the engaging notches 34 but so limited as to prevent the engaging notches 34 from being disengaged from the associated projection on the supporting shaft 71. Reference numerals 37 and 38, respectively, designate a stop piece and a locking piece formed integrally with the conversion shaft 35 and located within an opening 25 adjacent the front side and adjacent the rear side, respectively, (FIG. 11). Reference numeral 41 designates a predetermined client key and reference numberal 42 designates a key guiding member rotatably supported in the lock housing 11 and adapted to receive and rotatably support the client key 41. Integrally formed with key guiding member 42 is an arm 43 to permit the running plate 22 to longitudinally slidably retract and advance along a given end surface of the opening 25 formed in running plate 22.

The reference numeral 51 designates tumblers of the bank lock and although only one tumbler is shown for simplified illustration, there are normally provided a stacked plurality of such tumblers as in the case of the tumblers 31 for the client lock. Each of the tumblers 51 is provided along its left side edge with spaced engaging notches 54 in the form of saw-teeth and in its right side portion with an opening to receive the fence 24 and a gate 52 formed in continuity with said opening. The gate 52 allows the fence 24 to enter thereinto and allows the running plate 22 to be retracted. There is provided between the engaging notches 54 and the gate 52 a fan-shaped or arcuate opening 53. Selected engaging notch 54 releasably engages the other projection formed on the supporting shaft 71 and, when such engagement is established, the tumblers 51 are rotatable around the respective engaging notches 54. Adjacent the middle upper portion of the tumblers 51, there is provided a spring normally downwardly biasing the tumblers 51, so that the tumblers 51 are rockably biased clockwise when engaging notches 54 are engaged with said other projection on the supporting shaft 71. A conversion shaft 55 extends through the opening 25 of the running plate 22 and an opening 53 formed in the tumblers 51. Conversion shaft 55 is rotatably supported in the lock housing 11 and is rotatable by a predetermined conversion key from the rear side of the lock housing 11. Furthermore, the conversion shaft 55 is provided with an eccentric portion 56 which, at the normal position as shown by FIG. 1, bears against the left side surface of the opening 53, urging the tumblers 51 against the supporting shaft 71 so that one of the engaging notches 54 is engaged with the other projection on the supporting shaft 71. Between the opening 53, the conversion shaft 55 and the eccentric portion 56, there is provided a play sufficient to allow a smooth rotation of the tumblers 51 around the engaging notches 54 but limited so as to prevent the engaging notches 54 from being disengaged from said other projection. A stop piece 57 is formed integrally with the conversion shaft 55 and located within the opening 25 of the running plate 22 adjacent the front side thereof. A locking piece 58 is formed on stop piece 57 and located within the opening 25 adjacent the rear side thereof (FIG. 11).

Reference numeral 61 designates a predetermined bank key and reference numeral 62 designates a key guiding member rotatably supported in the lock housing 11 and adapted to rotatably support bank key 61. Integrally with the key guiding member 62, there is formed a locking piece 63 located within a transverse extension of the running plate 22 in the direction of its thickness.

Considering now the manner in which the safe-deposit box lock mechanism described above is manipulated and operated FIGS. 1 and 2 both correspond to the mechanism locked state. In this state, the fences 23, 24 are in engagement with the ends of the gates 32, 52, respectively, to block retraction of running plate 22 which is in its locked position so that the locking bar 21 cannot be retracted into the lock housing. The stop piece 37 has its upper end in engagement with the upper face of opening 25 so as to prevent the conversion shaft 35 from being further rotated while the stop piece 57 has its right end in engagement with the right face of opening 25 so as to prevent the conversion shaft 55 from being further rotated, so that both conversion shafts 35, 55 are held in their fixed positions.

To unlock, the predetermined bank key 61 is inserted into the key guiding member 62 and then rotated clockwise until the key 61 is vertically oriented as viewed in the drawings. During such manipulation, the key crest of the bank key 61 bears against the lower ends of the tumblers 51, urging them upward and the tumblers 51 are rotated counterclockwise around the engaged notches 54. Thus the tumblers 51 are held at their unlocked positions at which the gate 52 is longitudinally aligned with the fence 24.

Then, the prescribed client key 41 is inserted into the key guiding member 42 and rotated clockwise. The key crest of the client key 41 bears against the lower ends of the tumblers 31 and client key 41 is rotated to a substantially vertical orientation as viewed in the drawings so that the tumblers 31 are urged upward and rotated clockwise around the respective engaged notches 34. Thus the tumblers 31 are held at their unlocked positions at which the gate 32 is longitudinally aligned with the fence 23. During further clockwise rotation of the client key 41, the arm 43 comes in slidable contact with a given end surface of the opening 25 formed in the running plate 22, retracting the fence 23 into the gate 32 and the fence 24 into the gate 52 so that the running plate 22 is retracted thereby to its unlocked position. Concurrently, the locking bar 21 is retracted into the lock housing and unlocking is completed. After the bank key 61 is brought back to its lock position and withdrawn from the key guiding member, merely bringing the client key 41 back to its lock position causes the running plate 22 to be advanced to its lock position and causes, at the same time, the locking bar 21 to project from the lock housing. Concurrently, the fences 23, 24 leave the respective gates 32, 52 and the tumblers 31, 51 are rotated counterclockwise and clockwise, respectively, under the influence of the associated springs and automatically return to their lock positions as shown in FIG. 1. The manipulation and the operation which have been described hereinabove are identical to those of the prior safe-deposit box lock mechanism.

Now a manner in which the key-exchange is accomplished will be described in detail. In the case of the embodiment as described above and as shown, the improved mechanism is adapted for mutually independent key-exchanges for the client lock and the bank lock. Accordingly an explanation will first be given for the key-exchange of the client lock which occurs more frequently than the key-exchange of the bank lock.

Figure 3:
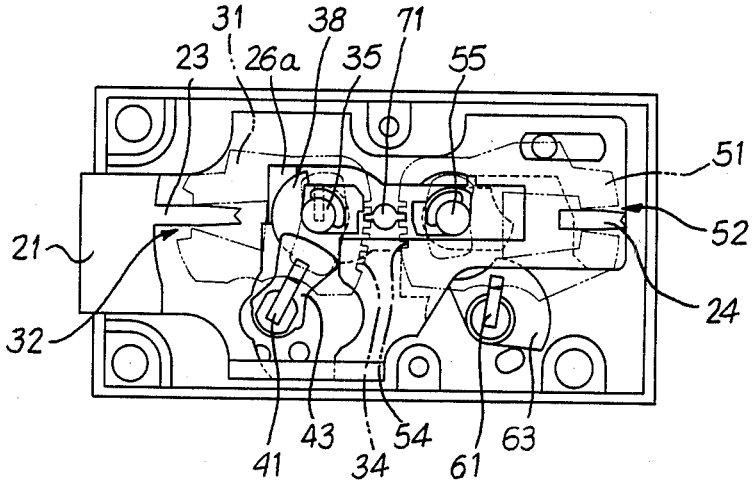
FIGS. 3 through 6 are schematic front views similar to FIG. 1 showing the essential successive steps in the key-exchanging operation for the client lock.

As will be best seen in FIG. 2, the conversion shaft 35 is not rotatable when the running plate 22 occupies its lock position, since the stop piece 37 is substantially in engagement with both the upper and the lower opposing end faces of the opening 25. The client lock and the bank lock are released by the prescribed client and bank keys 41, 61, respectively, and the locking bar 21 is thus retracted into the lock housing. Consequently fence 23 enters gate 32 and running plate 22 has its engaging portion **26*a* (FIG. 11) formed on the left end surface of the opening 25 thereof as a part of the running plate 22, which is defined by a rear side half of its thickness, bearing against the outer periphery of locking piece 38 carried by the conversion shaft 35. Thus the running plate 22 is held at its unlock position (FIG. 3). So long as the running plate 22 is held at this unlock position, a widened zone of the opening 25 is approximately above conversion shaft 35 and, in consequence, stop piece 37 for the conversion shaft 35 is disengaged from the opening 25. The locking piece 38 is in the form of a sector projecting from the conversion shaft 35 and concentric with the axis of the conversion shaft 35. The outer peripheral surface of this sector is in contact with the engaging portion 26***a* which is correspondingly curved relative to said outer peripheral surface so that the locking piece 38 does not prevent the conversion shaft 35 from being rotated. Therefore, the conversion shaft 35 can be rotated counterclockwise by the conversion key from its fixed position as shown by FIG. 3.

Figure 4:
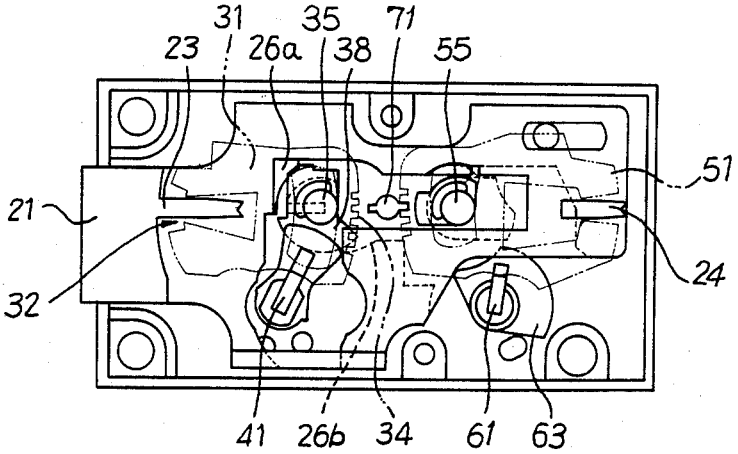

FIG. 4 shows the position for conversion at which the conversion shaft 35 has been rotated counterclockwise from its fixed position substantially by 90°. The conversion shaft 35 is prevented by a stop planted on the lock housing 11 from further counterclockwise rotation. During this rotation of the conversion shaft 35 substantially by 90°, the eccentric portion 36 which has been pressed against the right-hand surface of the opening 33 formed in the tumblers 31 now slidably bears against the left-hand surface of the opening 33 and thereby moves the tumblers 31 leftward. This movement causes the engaging notches 34 to disengage the associated projection on the supporting shaft 71 and the tumblers 31 become rotatable around a point at which the gate 32 bears against the fence 23 so that the tumblers 31 are rotated under the biasing effect of the associated spring until the lower end surfaces of the tumblers 31 come into contact with the key crest of the client key 41. After the conversion shaft 35 has been rotated to the position for conversion as shown by FIG. 4, the locking piece 38 parts from the engaging portion 26*a* and it becomes possible to further retract the running plate 22.

Figure 5:
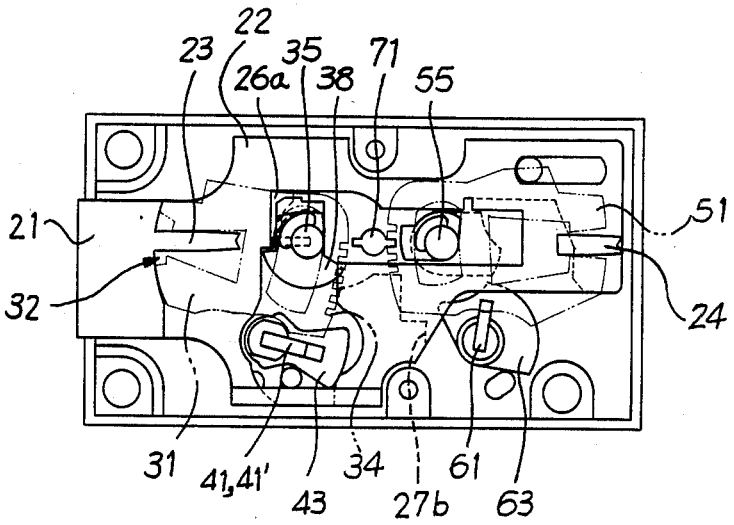

FIG. 5 corresponds to the state in which the client key 41 has been further rotated clockwise and thereby the running plate 22 has been further retracted to the position for conversion. During said further clockwise rotation of the client key 41, the tumblers 31 with their lower end surfaces bearing against the key crest of the client key 41 are rotated around the point at which they bear against the fence 23. So far as the running plate 22 occupies the position for conversion, a lower step of the engaging portion 26*a* is engaged with a terminal step of the sector serving as the locking piece 38 and thereby prevents the conversion shaft 35 from being rotated clockwise. The conversion shaft 35 is thus held at the position for conversion. The key guiding member 42 is so shaped that it allows the key-exchange at the position for conversion as shown by FIG. 5 and at this position the client key 41 may be replaced by a new client key 41'.

Figure 6:
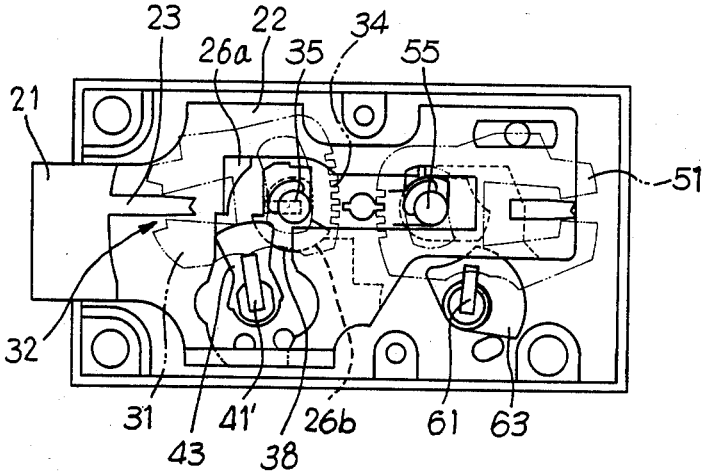

After the new client key 41' has been inserted into the key guiding member 42, this client key 41' is rotated counterclockwise. During this rotation, the tumblers 31 are lifted by the key crest of the client key 41' slidably bearing against the lower end surfaces of tumblers 31 and rotated around the point at which the gate 32 bears against the fence 23. The running plate 22 is advanced as the end surface of its opening 25 is urged by the arm 43. After the client key 41' has been rotated in the manner of normal unlocking manipulation to the unlock position at which the gate 32 of the tumblers 31 is aligned with the fehce 23, the engaging portion 26*b* (FIG. 11) formed in the opening 25 at its rear side is engaged with the locking piece 38 to block advancement of the running plate 22 and, as a result, the client key 41' cannot be further rotated counterclockwise. In this state, the step of the locking piece 38 is no longer engaged with the corresponding step of the engaging portion 26*a* and the conversion shaft 35 is therefore allowed to be rotated clockwise (FIG. 6). When the conversion shaft 35 is rotated clockwise by the key for conversion to its fixed position, the eccentric portion 36 is pressed against the right side surface of the opening 33 formed in the tumblers 31 and displaces the tumblers 31 with their lower end surfaces maintained in contact with the key crest of the client key 41' in such a direction that one of the engaging notches 34 comes into engagement with the associated projection on the supporting shaft 71. Upon engagement of said one notch with said projection, it becomes possible to advance the running plate 22 to the lock position and thus conversion of the axis around which the tumblers 31 are rotatable, namely, manipulation of key-exchange, is completed. With such manipulation as has been described hereinabove, the safe-deposit box can be locked and unlocked by use of the new client key 41'.

In the key-exchange procedure for the bank lock, in the locking position as shown by FIG. 2, the engaging portion 57*b* of the stop piece 57 bears against the lower end surface of the opening 25 to prevent the conversion shaft 55 from being rotated counterclockwise while the engaging portion 57*a* of the stop piece 57 bears against the right-hand surface of the opening 25 formed in the running plate 22 to prevent the conversion shaft 55 from being rotated clockwise. Thus, the conversion shaft 55 is held at its fixed position.

Figure 7:
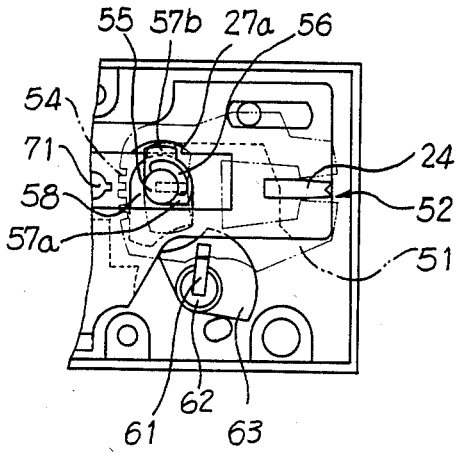
FIGS. 7 through 10 are fragmentary schematic front views showing the important parts at the respective successive essential steps of the key-exchanging operation for the bank lock.

Also for the key-exchange of the bank lock, the safe-deposit box is unlocked by the prescribed bank and client keys 61, 41, first of all (FIG. 3). When the running plate 22 is retracted to the unlock position, the fence 24 enters into the gate 52 and the right end surface of the opening 25 parts from the engaging portion 57*a* so that the conversion shaft 55 can be rotated clockwise. Now the conversion shaft 55 is rotated clockwise by the conversion key substantially by 90° to the position for conversion. During this rotation, the eccentric portion 56 is slidably pressed against the right side surface of the opening 53 formed in the tumblers 51 and thereby moves the tumblers 51 rightward while the tumblers 51 are maintained along their lower end surfaces in contact with the key crest of the bank key 61. As the tumblers 51 are thus moved rightward, the engaging notches 54 are disengaged from the associated projection on the supporting shaft 71 and the tumblers 51 become rotatable around the point at which the gate 52 bears against the fence 24. Such a state is shown by FIG. 7. In this state, the engaging portion 57*b* of the locking piece 57 bears against the step of a recess 27*a* formed in the upper edge of the opening 25 on the front side so that, when the running plate 22 is advanced by rotating the client key 41 in the direction of locking, the conversion shaft 55 is rotated counterclockwise by the stop piece 57 back to the fixed position and thus the tumblers 51 are brought back to the positions as shown by FIG. 1.

Figure 8:
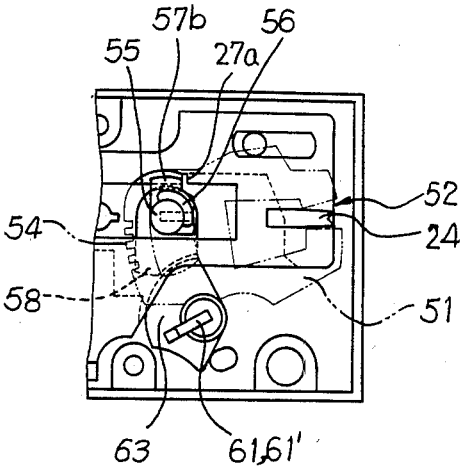

When the bank key 61 is rotated from the position as shown by FIG. 7 to the lock position, the tumblers 51 are rotated counterclockwise under the influence of the associated spring around the point at which the gate 52 bears against the fence 24. In this state, the locking piece 63 formed integrally with the key guiding member 62 is in engagement with the locking piece 58 for the conversion shaft 55 and thereby the conversion shaft 55 is restrained against clockwise rotation, namely, it is impossible to bring the conversion shaft 55 back to the fixed position (FIG. 8). Accordingly, the client key 41 cannot be rotated to the lock position, in this state, since the running plate 22 is prevented from being retracted.

Figure 9:
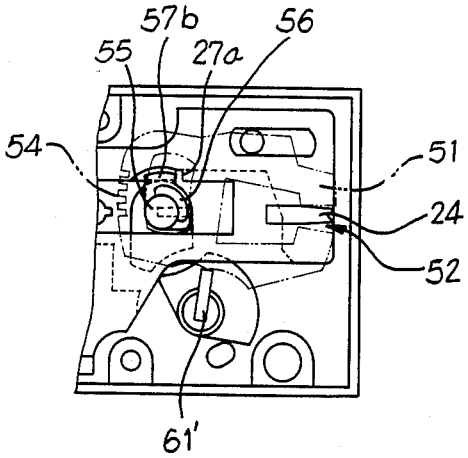
Figure 10:
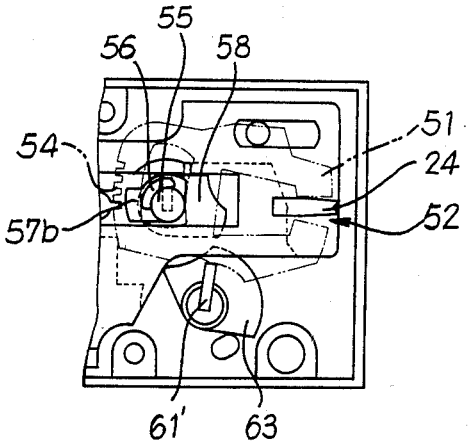

From the state of FIG. 8, the bank key 61 is pulled out from the key guiding member and a new bank key 61' is inserted therein and is rotated clockwise or in the direction of normal unlocking. During this rotation, the tumblers 51 are lifted by the key crest of the bank key 61', being slidably pressed against the lower end surfaces of the tumblers 51 and rotated clockwise around the point at which the gate 52 bears against the fence 24. In this state, the locking piece 63 is out of engagement with the locking piece 58 and accordingly the conversion shaft 55 can be rotated counterclockwise to the fixed position (FIG. 9). During this counterclockwise rotation of the conversion shaft 55 to the fixed position, the eccentric portion 56 is slidably pressed against the left end surface of the opening 53 formed in the tumblers 51, moving the engaging notches 54 toward the supporting shaft 71 while the tumblers 51 are maintained in contact with the key crest of the bank key 61' along the lower end surfaces of the tumblers 51 until one of said engaging notches 54 comes into engagement with the associated projection of the supporting shaft 71. The key-exchange procedure is thus completed and the safe-deposit box can be locked and unlocked by the new bank key 61'.

As clearly understood from the foregoing description, the lock constructed according to the present invention is free from a danger of falling into a non-releasable state even when the prescribed keys for unlocking or conversion are rotated in an erroneous sequence, so far as these keys are rotated in the rotatable directions.

The particular embodiment as shown is so arranged that, when the running plate 22 occupies its position for conversion, the locking piece 63 of the key guiding member 62 bears against the engaging portion **27*b* formed on the rear side of the running plate 22 so as to block the rotation of the bank key (FIG. 5) so that the client key and the bank key cannot be simultaneously rotated in the direction of unlocking. However, an alternative arrangement is also possible by removal of said engaging portion 27*b*** so that both the client key and the bank key can be simultaneously key-exchanged.

The key-exchangeable lock of the present invention constructed as described above possesses numberous advantages. Even when an improper procedure of manipulation is effected, or vibration or other undesirable conditions occur during the normal locking and unlocking procedures, there is no danger of the inadvertent shifting of the rotational axis of the tumblers in the locked state, since the conversion shaft is prevented from being rotated and, in the unlocked state, the conversion shaft is rotated from its fixed position but there is no danger that a locking might occur with the rotational axis of the tumblers being displaced, since the locking cannot be achieved unless the conversion shaft occupies its fixed position.

During the key-exchange operation, the keys or the conversion shaft can be rotated only in the direction for proper key-exchange or in the direction tracing back this sequence of proper key-exchange. Accordingly, there is no danger that the tumblers might be fixed with their rotational axis being displaced even when the operator forgets the proper sequence of key-exchange or follows an erroneous sequence. It is possible with the mechanism of the present invention to arrange the tumblers so that the locking and the unlocking may be achieved by the initial keys or the new keys.

The key-exchangeable lock according to the present invention can be conveniently used for various applications such as for a safe-deposit box as shown in the accompanying drawings as the preferred embodiment.

What is claimed is:

1. A key-exchangeable lock including a lock housing, and within said lock housing a running plate provided with a fence, a locking bar longitudinally movable with said running plate and a plurality of tumblers adapted to cooperate with said fence so as to allow, in a predetermined unlocking position, the running plate to be retracted, wherein said tumblers are moved to said unlocking position and said running plate is retracted to its unlock position by rotation of a prescribed key; and wherein said prescribed key is exchangeable with another prescribed key by displacing the rotational axes of said tumblers, characterized in that said tumblers and running plate are formed with openings;

a conversion shaft rotatably supported in the lock housing extends through said openings formed in said tumblers and running plate;

said conversion shaft is provided with an eccentric portion adapted to be pressed against an end surface of said opening formed in said tumblers to fix the rotational axes of said tumblers when said conversion shaft occupies a predetermined fixed position but to release said rotational axes of the tumblers when said conversion shaft occupies a predetermined conversion position, a stop piece adapted to cooperate with said opening of the running plate so as alternatively to block and to allow rotation of said conversion shaft and a locking piece adapted to cooperate with said opening of the running plate so as alternatively to block and to allow displacement of said running plate and rotation of said conversion shaft;

said stop piece engages one edge of the opening formed in said running plate to hold said conversion shaft at its fixed position when the running plate occupies its lock position and said stop piece is disengaged from said opening of the running plate to allow rotation of the conversion shaft when the running plate occupies its unlocking position;

said locking piece is engaged with one edge of the opening formed in the running plate to lock retreat of said running plate at a predetermined unlock position when the conversion shaft occupies its fixed position and said locking piece is disengaged from said one edge of the opening formed in the running plate to allow retreat of said running plate from said unlocking position to its conversion position when said conversion shaft occupies its conversion position;

said locking piece is engaged with one edge of the opening formed in said running plate to hold said conversion shaft at its conversion position when said running plate occupies its conversion position; and advancement of said running plate from its position for conversion is blocked by engagement of said locking piece with said one edge of the opening formed in the running plate as said prescribed key has moved said tumblers to their unlocking positions.

2. A key-exchangeable lock according to claim 1, wherein said tumblers are provided at the side opposed to said fence with a gate allowing said fence to enter thereinto and at the side opposite to said gate with engaging notches in the form of saw-teeth so that one of said engaging notches is engaged with a projection formed on a supporting shaft stationarily provided in the lock housing and said tumblers are rotatable around a point of this engagement.

3. A key-exchangeable lock according to claim 1, wherein said stop piece and said locking piece are formed integrally with said conversion shaft so that said stop piece lies within one-half thickness of the opening formed in said running plate at the front side while said locking piece lies within one-half thickness of said opening formed in said running plate.

4. A key-exchangeable lock including a lock housing, and within said lock housing a running plate provided with a fence, a locking bar longitudinally movable with said running plate and a plurality of tumblers adapted to cooperate with said fence so as to allow, in a predetermined unlocking position, the running plate to be retracted, wherein said tumblers are moved to said unlocking position and said running plate is retracted to its unlock position by rotation of a prescribed key; and wherein said prescribed key is exchangeable with another prescribed key by displacing the rotational axes of said tumblers, characterized in that said tumblers and running plate are formed with openings;

a conversion shaft rotatably supported in the lock housing extends through said openings formed in said tumblers and running plate;

said conversion shaft is provided with an eccentric portion adapted to be pressed against an end surface of said opening formed in said tumblers to fix the rotational axes of said tumblers when said conversion shaft occupies a predetermined fixed position but to release said rotational axes of the tumblers when said conversion shaft occupies a predetermined conversion position, a stop piece adapted to cooperate with said opening of the running plate so as alternatively to block and to allow rotation of said conversion shaft and a locking piece adapted to cooperate with another locking piece provided on a key guiding member rotatably supporting said prescribed key so as alternatively to block and to allow rotation of the conversion shaft;

said stop piece engages one edge of the opening formed in said running plate to hold said conversion shaft at its fixed position when the running plate occupies its lock position and said stop piece is disengaged from said opening in the running plate to allow rotation of the conversion shaft; when the running plate occupies its unlocking position; and when the running plate occupies its unlocking position while the prescribed key occupies its locking position, said locking piece is engaged with said another locking piece of said key guiding member to hold the conversion shaft at its conversion position and said stop piece is engaged with one edge of the opening formed in the running plate to block advancement of said running plate.

5. A key-exchangeable lock according to claim 4, wherein said tumblers have engaging notches in the form of sawteeth at one side and the opening adapted to receive the fence and the gate formed in continuity with said opening allowing said fence to enter thereinto at the opposite side with respect to the opening for receiving the conversion shaft; and wherein one of said engaging notches is engaged with a projection formed on a supporting shaft stationarily supported in the lock housing and said tumblers are rotatable around a point of this engagement.

6. A key interchangeable lock mechanism comprising a slide plate longitudinally movable between advanced and retracted positions, a lock bar longitudinally movable with said slide plate, a fence carried by and movable with said slide plate, a plurality of transversely spaced rockable tumblers having, each tumbler at its outer end a gate movable into and out of longitudinal registry with said fence and at its inner end a plurality of vertically spaced pivot points, a fixed fulcrum member releasably engaged with a selected pivot point of each of said tumblers and a key guide member for supporting a key for rotation into engagement with said tumblers to rock said tumblers about said fulcrum member, said lock being characterized by:

conversion means movable between retracted and advanced positions for longitudinally shifting said tumblers between advanced positions with a pivot point of each of said tumblers engaging said fixed fulcrum member and retracted positions with said pivot points being longitudinally disengaged from said fixed fulcrum member;

means for disabling said conversion means from longitudinally retracting said tumblers from rocking engagement with said fulcrum member when said slide plate is in advance of its fully retracted position;

said tumblers in their retracted positions being rockable about said fence to vertically move said disengaged pivot points to positions responsive to the shape of a key engaging and rotatable with said key guide, and upon said tumblers being longitudinally advanced by said conversion means said key determined tumbler pivot points engaged said fulcrum member.

7. The lock mechanism of claim 6 including means responsive to the advanced position of said slide plate for locking said conversion means in its retracted position.

8. The lock mechanism of claim 6 including means responsive to the advanced position of said conversion means for locking said slide plate in its retracted position.

* * * * *